US011072917B2

(12) United States Patent
Alcorn

(10) Patent No.: US 11,072,917 B2
(45) Date of Patent: Jul. 27, 2021

(54) ACTUATION APPARATUS

(71) Applicant: A. Shane Alcorn, Sandy, UT (US)

(72) Inventor: A. Shane Alcorn, Sandy, UT (US)

( * ) Notice: Subject to any disclaimer, the term of this patent is extended or adjusted under 35 U.S.C. 154(b) by 16 days.

(21) Appl. No.: 16/776,023

(22) Filed: Jan. 29, 2020

(65) Prior Publication Data

US 2020/0165804 A1 May 28, 2020

Related U.S. Application Data

(63) Continuation-in-part of application No. 16/195,671, filed on Nov. 19, 2018, now Pat. No. 10,570,598, which is a continuation of application No. 15/011,903, filed on Feb. 1, 2016, now Pat. No. 10,138,624.

(60) Provisional application No. 62/111,711, filed on Feb. 4, 2015.

(51) Int. Cl.

| | |
|---|---|
| ***E03D 1/35*** | (2006.01) |
| ***E03D 5/02*** | (2006.01) |
| ***E03D 11/00*** | (2006.01) |

(52) U.S. Cl.

CPC ..... *E03D 1/35* (2013.01); *E03D 5/022* (2013.01); *E03D 11/00* (2013.01)

(58) Field of Classification Search

CPC ..... E03D 1/35; E03D 5/022; E03D 11/00
USPC ..... 4/427; 137/409
See application file for complete search history.

(56) References Cited

U.S. PATENT DOCUMENTS

| | | | | |
|---|---|---|---|---|
| 4,709,427 | A | 12/1987 | Laverty | |
| 4,891,864 | A | 1/1990 | Laverty | |
| 4,974,264 | A | 12/1990 | Brian | |
| 5,769,719 | A | 6/1998 | Harvey | |
| 6,810,902 | B2 * | 11/2004 | Bootka | E03C 1/242 137/312 |
| 9,631,352 | B2 * | 4/2017 | Alcorn | E03D 9/00 |
| 10,138,624 | B1 | 11/2018 | Alcorn | |
| 10,570,598 | B2 * | 2/2020 | Alcorn | E03D 5/022 |
| 2005/0071914 | A1 | 4/2005 | Marshall | |
| 2005/0132483 | A1 | 6/2005 | Butsch et al. | |
| 2006/0096017 | A1 | 5/2006 | Yamasaki | |
| 2008/0141447 | A1 | 6/2008 | Bowcutt et al. | |
| 2015/0247311 | A1 | 9/2015 | Alcorn | |

* cited by examiner

*Primary Examiner* — Huyen D Le
(74) *Attorney, Agent, or Firm* — Kunzler Bean & Adamson

(57) ABSTRACT

Disclosed herein is actuation apparatus. The actuation apparatus comprises a diaphragm valve, having an upstream side and a downstream side, opposite the upstream side. The actuation apparatus also comprises a hydraulic actuator, fluidically coupled with the downstream side of the diaphragm valve by a first hydraulic line. The actuation apparatus further comprises a valve fluidically coupled with the upstream side of the diaphragm valve by a second hydraulic line. The actuation apparatus additionally comprises a valve controller coupled with the valve and operable to open and close the valve. Pressurized fluid from the downstream side of the diaphragm valve flows to the hydraulic actuator, via the first hydraulic line, in response to opening of the valve. The hydraulic actuator is configured to actuate in response to receipt of pressurized fluid from the downstream side of the diaphragm valve.

20 Claims, 3 Drawing Sheets

ACTUATION APPARATUS

CROSS-REFERENCE TO RELATED APPLICATIONS

This application is a continuation-in-part of U.S. patent application Ser. No. 16/195,671, filed Nov. 19, 2018, which is a continuation of U.S. Pat. No. 10,138,624, which claims the benefit of U.S. Patent Application No. 62/111,711, filed Feb. 4, 2015, all of which are incorporated herein by reference.

FIELD

The present invention relates to hydraulic actuation apparatuses and more especially to remotely actuating hydraulic actuation apparatuses that can be used in a toilet or the like to perform work based upon a sensed condition preferably without the use of electricity.

BACKGROUND

Hydraulic actuation apparatuses which actuate and perform predetermined work based upon predetermined conditions are well known. An actuation apparatus is disclosed in U.S. patent application Ser. No. 14/630,378 which is incorporated herein in its entirety. However, such apparatuses typically require electronic sensors or actuators, or function to terminate actuation based on a predetermined water level.

SUMMARY

The subject matter of the present application has been developed in response to the present state of the art, and in particular, in response to the shortcomings of fluidically-powered actuator systems, that have not yet been fully solved by currently available techniques. Accordingly, the subject matter of the present application has been developed to provide an apparatus, system, and method for fluidically activating an actuator that overcome at least some of the above-discussed shortcomings of prior art techniques.

The following is a non-exhaustive list of examples, which may or may not be claimed, of the subject matter, disclosed herein.

Disclosed herein is actuation apparatus that comprises a diaphragm valve, having an upstream side and a downstream side, opposite the upstream side. The actuation apparatus also comprises a hydraulic actuator, fluidically coupled with the downstream side of the diaphragm valve by a first hydraulic line. The actuation apparatus further comprises a valve fluidically coupled with the upstream side of the diaphragm valve by a second hydraulic line. The actuation apparatus additionally comprises a valve controller coupled with the valve and operable to open and close the valve. Pressurized fluid from the downstream side of the diaphragm valve flows to the hydraulic actuator, via the first hydraulic line, in response to opening of the valve. The hydraulic actuator is configured to actuate in response to receipt of pressurized fluid from the downstream side of the diaphragm valve. The preceding subject matter of this paragraph characterizes example 1 of the present disclosure.

The valve and the valve controller are spatially remote from the diaphragm valve. The preceding subject matter of this paragraph characterizes example 2 of the present disclosure, wherein example 2 also includes the subject matter according to example 1, above.

The valve and the valve controller are spatially remote from the diaphragm valve by a distance corresponding with a length of the second hydraulic line. The preceding subject matter of this paragraph characterizes example 3 of the present disclosure, wherein example 3 also includes the subject matter according to any one of examples 1-2, above.

The actuation apparatus further comprises a pressurized fluid supply, fluidically coupled with the upstream side of the diaphragm valve by a third hydraulic line to supply pressurized fluid to the upstream side of the diaphragm valve. Pressurized fluid from the upstream side of the diaphragm valve is supplied to the valve via the second hydraulic line. The preceding subject matter of this paragraph characterizes example 4 of the present disclosure, wherein example 4 also includes the subject matter according to any one of examples 1-3, above.

Pressurized fluid from the valve is supplied to the downstream side of the diaphragm valve, via a fourth hydraulic line, when the valve is open. The preceding subject matter of this paragraph characterizes example 5 of the present disclosure, wherein example 5 also includes the subject matter according to example 4, above.

The actuation apparatus further comprises a dump port fluidically coupled with the valve. The valve is configured to supply a portion of pressurized fluid received from the diaphragm valve to the dump port when the valve is open. The preceding subject matter of this paragraph characterizes example 6 of the present disclosure, wherein example 6 also includes the subject matter according to example 4, above.

The diaphragm valve supplies pressurized fluid to the hydraulic actuator by non-mechanical hydraulic actuation of the diaphragm valve by pressurized fluid from the pressurized fluid supply. The preceding subject matter of this paragraph characterizes example 7 of the present disclosure, wherein example 7 also includes the subject matter according to any one of examples 4-6, above.

The diaphragm valve supplies pressurized fluid to the hydraulic actuator only by non-mechanical hydraulic actuation of the diaphragm valve caused by pressurized fluid passing through the valve. The preceding subject matter of this paragraph characterizes example 8 of the present disclosure, wherein example 8 also includes the subject matter according to any one of examples 1-7, above.

The valve controller comprises a sensing device configured to sense at least one condition. The valve controller is configured to either open or close the valve in response to the at least one condition, sensed by the sensing device, meeting a predetermined threshold. The preceding subject matter of this paragraph characterizes example 9 of the present disclosure, wherein example 9 also includes the subject matter according to any one of examples 1-8, above.

The valve controller is configured to either open or close the valve according to a predetermined schedule. The preceding subject matter of this paragraph characterizes example 10 of the present disclosure, wherein example 10 also includes the subject matter according to any one of examples 1-9, above.

The valve is non-electrically coupled with the diaphragm valve. The preceding subject matter of this paragraph characterizes example 11 of the present disclosure, wherein example 11 also includes the subject matter according to any one of examples 1-10, above.

The valve controller is configured to receive a wireless communication signal form an electronic device. The valve controller is configured to either open or close the valve in response to receipt of the wireless communication signal. The preceding subject matter of this paragraph characterizes example 12 of the present disclosure, wherein example 12 also includes the subject matter according to any one of examples 1-11, above.

The valve controller comprises a physically actuatable component. The valve controller is configured to either open or close the valve in response to the physically actuatable component being physically actuated. The preceding subject matter of this paragraph characterizes example 13 of the present disclosure, wherein example 13 also includes the subject matter according to any one of examples 1-12, above.

Further disclosed herein is an actuation apparatus that comprises a diaphragm valve, having an upstream side and a downstream side, opposite the upstream side. The actuation apparatus also comprises a hydraulic actuator, fluidically coupled with the downstream side of the diaphragm valve by a first hydraulic line. The actuation apparatus additionally comprises a valve, fluidically coupled with the upstream side of the diaphragm valve by a second hydraulic line. The actuation apparatus further comprises a valve controller coupled with the valve and operable to open and close the valve. Pressurized fluid from the downstream side of the diaphragm valve flows to the hydraulic actuator, via the first hydraulic line, in response to opening of the valve. The hydraulic actuator is configured to actuate in response to receipt of pressurized fluid from the downstream side of the diaphragm valve. The diaphragm valve and the hydraulic actuator are exclusively fluidically-powered and non-electric. The preceding subject matter of this paragraph characterizes example 14 of the present disclosure.

The valve is spatially remote from the diaphragm valve. The preceding subject matter of this paragraph characterizes example 15 of the present disclosure, wherein example 15 also includes the subject matter according to example 14, above.

The valve controller comprises a sensing device configured to sense at least one condition. The valve controller is configured to either open or close the valve in response to the at least one condition, sensed by the sensing device, meeting a predetermined threshold. The preceding subject matter of this paragraph characterizes example 16 of the present disclosure, wherein example 16 also includes the subject matter according to any one of examples 14-15, above.

The valve controller is configured to either open or close the valve according to a predetermined schedule. The preceding subject matter of this paragraph characterizes example 17 of the present disclosure, wherein example 17 also includes the subject matter according to any one of examples 14-16, above.

The valve controller is configured to receive a wireless communication signal form an electronic device. The valve controller is configured to either open or close the valve in response to receipt of the wireless communication signal. The preceding subject matter of this paragraph characterizes example 18 of the present disclosure, wherein example 18 also includes the subject matter according to any one of examples 14-17, above.

The valve controller comprises a physically actuatable component. The valve controller is configured to either open or close the valve in response to the physically actuatable component being physically actuated. The preceding subject matter of this paragraph characterizes example 19 of the present disclosure, wherein example 19 also includes the subject matter according to any one of examples 14-18, above.

Additionally disclosed herein is a toilet. The toilet comprises a diaphragm valve, having an upstream side and a downstream side, opposite the upstream side. The toilet also comprises a hydraulic actuator, fluidically coupled with the downstream side of the diaphragm valve by a first hydraulic line. The toilet further comprises a valve fluidically coupled with the upstream side of the diaphragm valve by a second hydraulic line. The toilet additionally comprises a valve controller coupled with the valve and operable to open and close the valve. Pressurized fluid from the downstream side of the diaphragm valve flows to the hydraulic actuator, via the first hydraulic line, in response to opening of the valve. The hydraulic actuator is configured to actuate in response to receipt of pressurized fluid from the downstream side of the diaphragm valve. The preceding subject matter of this paragraph characterizes example 20 of the present disclosure.

The described features, structures, advantages, and/or characteristics of the subject matter of the present disclosure may be combined in any suitable manner in one or more examples and/or implementations. In the following description, numerous specific details are provided to impart a thorough understanding of examples of the subject matter of the present disclosure. One skilled in the relevant art will recognize that the subject matter of the present disclosure may be practiced without one or more of the specific features, details, components, materials, and/or methods of a particular example or implementation. In other instances, additional features and advantages may be recognized in certain examples and/or implementations that may not be present in all examples or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1:
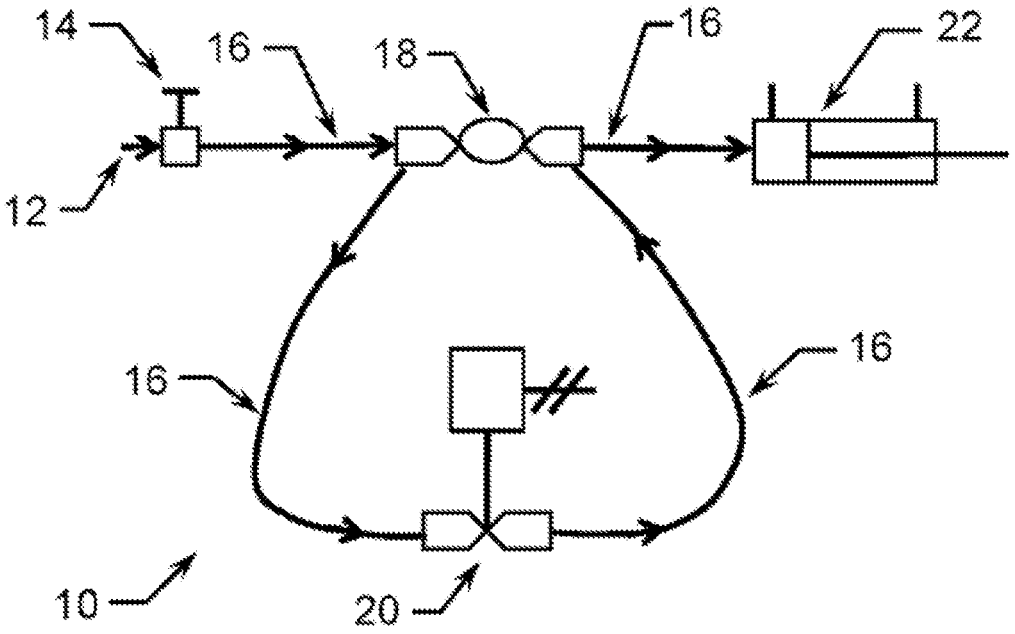
FIG. 1 is a schematic view of an actuation apparatus having a float valve return water line, according to one or more examples of the present disclosure.

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples. As used in the drawings, elements and/or components, if any, represented with dashed lines, indicate alternative examples of the subject matter, disclosed herein. One or more elements shown in solid and/or dashed lines may be omitted from a particular example without departing from the scope of the subject matter, disclosed herein.

According to some examples, described herein is an actuation apparatus that includes a pressurized fluid source, such as a pressurized water source, a hydraulic valve, a fluid level sensor, and an actuator. The hydraulic valve preferably defines a diaphragm valve, the fluid level sensor preferably defines a water level sensor in the form of a float valve, and the actuator preferably defines a hydraulic linear cylinder actuator (actuator) or the like. The apparatus is adapted such that when the water level sensor senses water at above a predetermined level, such as by means of the float of a float valve "floating" or rising to a predetermined level based on a corresponding increase in a water level, the diaphragm valve "turns on" or repositions such that water is allowed to flow from the pressurized water source to the actuator and the actuator actuates. The apparatus is further adapted such that when the water level sensor senses water below a predetermined level by means of the float of the float valve "floating" or lowering to a predetermined level based on a corresponding decrease in a water level, the diaphragm valve "turns off" or repositions such that water is prevented from flowing from the pressurized water source to the actuator and the actuator actuates returns to a default position. An exemplary application of the apparatus is the incorporation of the apparatus in a toilet having an auxiliary discharge path such as that disclosed in U.S. provisional application 61/947,117 which is expressly incorporated herein in its entirety by reference.

In order to facilitate an understanding of the present invention in reviewing the drawings accompanying the specification, a feature list is provided below. It is noted that like features are like numbered throughout all of the figures.

FEATURE TABLE

| # | Feature | # | Feature |
|---|---|---|---|
| 10 | Actuation apparatus | 12 | Pressurized water supply |
| 14 | Water supply valve | 16 | Water lines |
| 18 | Diaphragm valve | 20 | Float valve |
| 22 | Actuator | | |
| 30 | Actuation apparatus | 32 | Pressurized water supply |
| 34 | Water supply valve | 36 | Water lines |
| 38 | Diaphragm valve | 40 | Float valve |

FEATURE TABLE-continued

| # | Feature | # | Feature |
|---|---|---|---|
| 42 | Actuator | 44 | Water dump port |
| 50 | Modular combination valve | 52 | Diaphragm valve |
| 54 | Float valve | 56 | Water lines |

Referring now to the drawings and in particular to FIG. 1, according to a first example, an actuation apparatus 10 having a pressurized water supply 12 (which preferably includes a water supply valve 14), a plurality of water lines 16 (e.g. tubing or pipes) adapted to carry pressurized water, a diaphragm valve 18, a water level sensing float valve 20 (which alternatively may be a diaphragm valve), and an actuator such as a linear cylinder actuator 22 (which may be a single acting actuator or a double acting actuator). The actuation apparatus 10 is configured such that a water line 16 is connected to pressurized water supply on a first end and to a first port of the diaphragm valve 18 on a second end. Another water line 16 of the actuation apparatus 10 is connected to a second port of the diaphragm valve 18 on a first end and to a first port of float valve 20 on a second end. The actuation apparatus 10 includes another water line 16 that is connected to a second port of the float valve 20 on a first end and to a third port of the diaphragm valve 18 on a second end. An additional water line 16 of the actuation apparatus 10 is connected to a fourth port of the diaphragm valve 18 on a first end and to a first port of actuator 22 on a second end. It is noted that the diaphragm valve 18, the float valve 20, and the actuator 22 may be arranged in close proximity to each other or a substantial distance from one another. For instance, the actuation apparatus 10 may be configured such that the float valve 20 senses a water level that is substantially remotely located from the diaphragm valve 18.

In a first embodiment in practice, the actuation apparatus 10 is adapted such that when water supply valve 14 is opened, the pressurized water 12 is supplied to the float valve 20 via the diaphragm valve 18. In a nominal or default position when the float of the float valve 20 is below a predetermined level, the float valve 20 remains closed. However, when water rises above a predetermined level causing the float of the float valve 20 to rise above a predetermined level, the float valve 20 opens and remains open while the float of the float valve 20 remains above a predetermined level. Opening of the float valve 20 causes the pressurized water 12 to flow to the diaphragm valve 18, which in turn causes the pressurized water 12 to flow from the diaphragm valve 18 to the actuator 22. The pressurized water 12 flowing to the actuator 22 causes the actuator 22 to actuate and perform work. Upon closing of the float valve 20, the pressurized water 12 ceases to flow from the float valve 20 to the diaphragm valve 18 and from the diaphragm valve 18 to the actuator 22, and the actuator 22 returns to a nominal or unactuated position.

Figure 2:
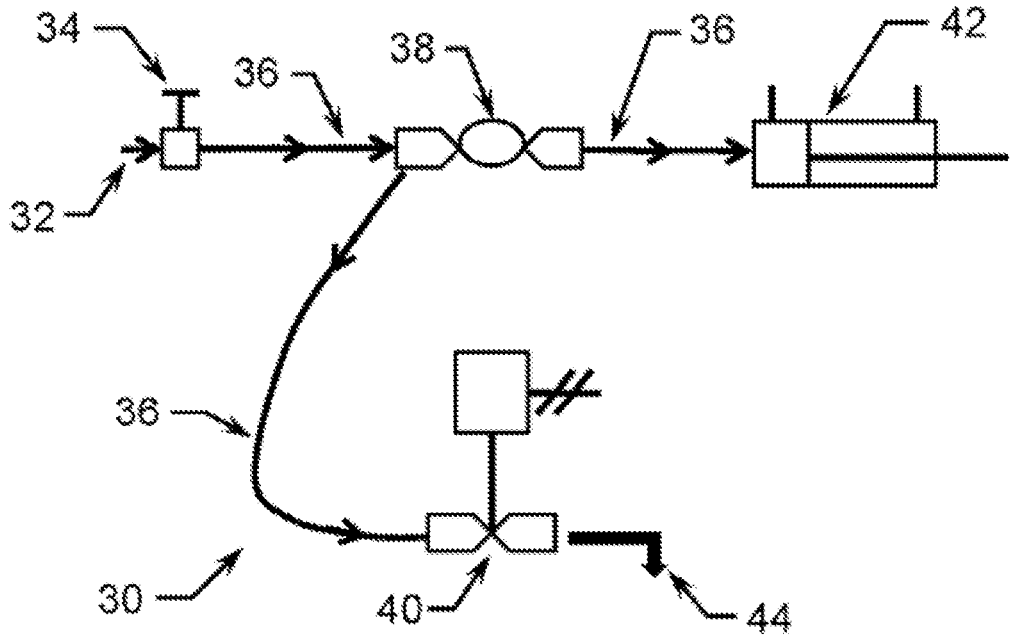
FIG. 2 is a schematic view of an actuation apparatus having a float valve water dump line, according to one or more examples of the present disclosure.

Referring now to FIG. 2, according to a second example, an actuation apparatus 30 having a pressurized water supply 32 (which preferably includes a water supply valve 34), a plurality of water lines 36 (e.g. tubing or pipes) adapted to carry pressurized water, a diaphragm valve 38, a water level sensing float valve 40 (which alternatively may be a diaphragm valve), an actuator 42 such as a linear cylinder actuator 42 (which may be a single acting actuator or a double acting actuator), and a water dump port 44. The actuation apparatus 30 is configured to have a water line 36 that is connected to the pressurized water supply 32 on a first end and to a first port of the diaphragm valve 38 on a second end. The actuation apparatus 30 also includes a water line 36 connected to a second port of diaphragm valve 38 on a first end and to a first port of float valve 40 on a second end. The actuation apparatus 30 further includes a water line 36 connected to a second port of the float valve 40 on a first end and to water dump port on a second end. The actuation apparatus 30 also includes a water line 36 connected to a third port of the diaphragm valve 38 on a first end and to a first port of actuator 42 on a second end. It is noted that diaphragm valve 38, float valve 40, and actuator 42 may be arranged in close proximity to each other or a substantial distance from one another. For instance, the actuation apparatus 30 may be configured such that the float valve 40 senses a water level that is substantially remotely located from the diaphragm valve 38.

In a second embodiment in practice, the actuation apparatus 30 is adapted such that when the water supply valve 34 is opened, the pressurized water 32 is supplied to the float valve 40 via the diaphragm valve 38. In a nominal or default position when the float of the float valve 40 is below a predetermined level, the float valve 40 remains closed. However, when water rises above a predetermined level causing the float of the float valve 40 to rise above a predetermined level, the float valve 40 opens and remains open while the float of the float valve 40 remains above a predetermined level. Opening of the float valve 40 causes the pressurized water 32 to flow from the diaphragm valve 38 to the actuator 42 and a minimal amount of the pressurized water 32 to flow to the water dump port 44. The pressurized water 32 flowing to the actuator 42 causes the actuator 42 to actuate and perform work. Upon closing of the float valve 40, the pressurized water 32 ceases to flow from the diaphragm valve 38 to the actuator 42, and the actuator 42 returns to a nominal or unactuated position, and water ceases to flow to the water dump port 44.

Figure 3:
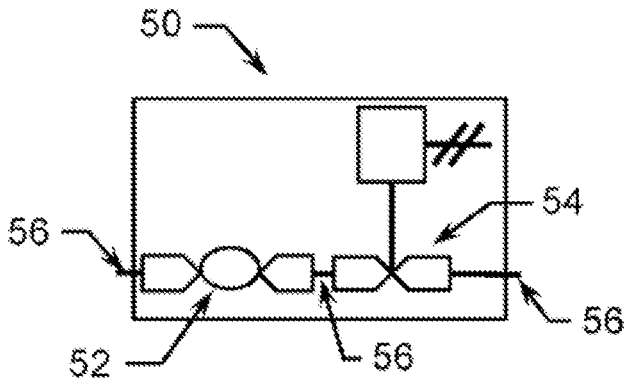
FIG. 3 is a schematic view of a modular combination float valve and diaphragm valve, according to one or more examples of the present disclosure.

Referring now to FIG. 3, according to another example, an optional modular combination valve 50 having a diaphragm valve 52, a float valve 54, and a plurality of water lines 56 (e.g. tubing or pipes) adapted to carry pressurized water is disclosed. For original installation as well as maintenance, modular combination valve 50 is adapted such that modular combination valve 50 may be installed in an actuation apparatus and replaced in an actuation apparatus as a single combination of both a diaphragm valve and a float valve.

Figure 4:
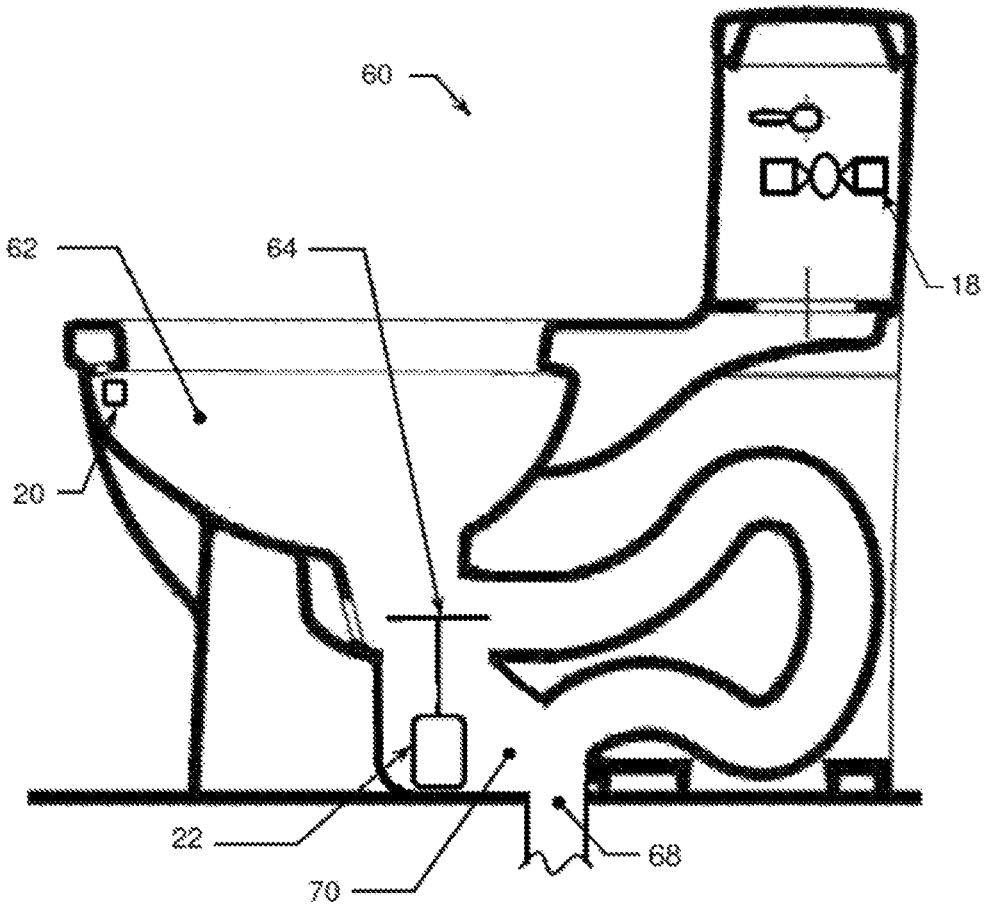
FIG. 4 is a schematic view of a toilet that includes an actuation apparatus, according to one or more examples of the present disclosure.

In an exemplary application of the actuation apparatus shown in FIG. 4, the apparatus is positioned with and adapted for use in actuating a toilet 60 having an auxiliary discharge path such as that disclosed in U.S. patent application Ser. No. 14/630,378 (hereinafter "'378"). For instance, actuation apparatus 10 (or optionally actuation apparatus 30) is adapted to toilet apparatus 60 (10, 30, 50, 70 of '378) as follows. Float valve 20 is positioned in a cavity of toilet apparatus 60, preferably behind toilet bowl 62 (12, 32, 52, 72 of '378), wherein the cavity is subject of filling and draining of water substantially corresponding to the filling and draining of toilet bowl 62 with liquid (e.g. the fluid levels of both bowl 62 and the cavity correspond substantially equally and substantially rise and fall together). Further, diaphragm valve 18 is positioned at a location of functional convenience within toilet apparatus 60 and actuator 22 (44 of '378) of auxiliary discharge valve 64 (22, 42, 62, 82 of '378).

In practice, with pressurized water available to float valve 20 and diaphragm valve 18, float valve 20 remains closed absent the rise of the float of float valve 20 above a predetermined level. However, when fluid rises in bowl 62 above a predetermined level (but preferably below a level that would cause overflow of bowl 62), fluid correspondingly rises a predetermined level in the cavity of the toilet 60 causing the float of float valve 20 to rise above a predetermined level. Rising of the float of float valve 20 above a predetermined level causes float valve 20 to open and pressurized water to flow from diaphragm valve 18 to actuator 22, causing actuator 22 to actuate. Actuation of actuator 22 causes auxiliary discharge valve 64 to open allowing contents of bowl 62 to be emptied directly to sewer line 68 via the auxiliary discharge path 70 (20, 40, 60, 80 of '378). Upon the lowering of the fluid level in bowl 62 to below a predetermined level, fluid in the cavity of the toilet apparatus 60 lowers a corresponding amount causing the float of float valve 20 to lower below a predetermined amount. Lowering of float of float valve 20 to lower than a predetermined amount causes float valve 20 to close, causing water to cease to flow from float valve 20 and diaphragm valve 18 and causing actuator 22 to return to a nominal position and to close auxiliary discharge valve 64.

By actuation apparatus 10 being thus adapted to toilet apparatus 60, not only is toilet apparatus 60 prevented from overflowing, but toilet apparatus 60 is prevented from overflowing without the use of any electronics (e.g. electronic sensor or actuators), and thus not only avoids electrical power consumption but provides for a more reliable toilet apparatus than would otherwise be available. Rather than separate stand-alone valves, in toilet apparatus 60, which incorporates actuation apparatus 10, float valve 20 and diaphragm valve 18 are preferably provided as modular combination valve 50 of FIG. 3, incorporating both a diaphragm valve and a float valve.

Figure 5:
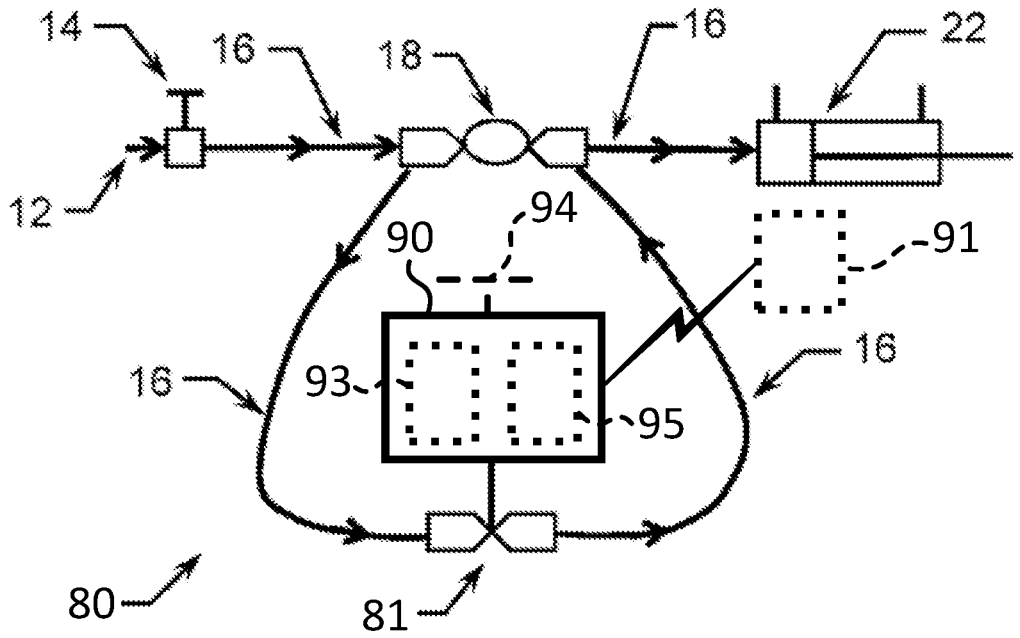
FIG. 5 is a schematic view of an actuation apparatus having a float valve return water line, according to one or more examples of the present disclosure.

Referring to FIG. 5, according to yet another example, an actuation apparatus 80 includes features similar to the actuation apparatus 10 of FIG. 1, with like numbers referring to like features. The general functionality of the actuation apparatus 80, as it relates to control of an actuator, such as the actuator 22, is similar to that of the actuation apparatus 10 as described above. However, unlike the actuation apparatus 10 of FIG. 1, the actuation apparatus 80 of FIG. 5 includes a valve 81 and a valve controller 90 instead of a water level sensing float valve 20. The valve 81 is configured to open and close, in response to input from the valve controller 90, to respectively allow fluid (e.g., water) to flow through the valve 81 or prevent fluid from flowing through the valve 81. The valve controller 90 is configured to open and close the valve 81 manually and/or automatically. In some implementations, in view of the below-described functionality, the combination of the valve 81 and the valve controller 90 can be considered a smart valve.

In some examples, the valve controller 90 is a manually-operated controller. In a first example, real-time manual operation of the valve controller 90 is accomplished by a physical actuation of the valve controller 90 to open and close the valve 81. According to the first example, the valve controller 90 includes a physically actuatable component 94, such as a knob, switch, handle, wheel, button, that a user can physically engage to control the valve controller 90 to open and close the valve 81. In some implementations, the valve controller 90 is a mechanical device that is mechanically coupled to the valve 81 via one or more mechanical linkages. The mechanical linkages are physically manipulated by a user, such as via a knob, handle, wheel, etc., to either open or close the valve 81. In such implementations, the force that opens and closes the valve 81 is supplied directly by the manual force used to actuate the physically actuatable component. However, in other implementations, the valve controller 90 includes a power-assist device 93, such as a motor, solenoid plunger, and the like, that utilizes a non-manual power source (e.g., electrical, hydraulic, etc.) to actuate the valve 81 in response to manual actuation of the physically actuatable component. For example, in one implementation, the valve controller 90 includes an electrically-powered device electrically coupled to the physically actuatable component via electrical circuitry and activatable to open and close the valve 81 by physical actuation of the physically actuatable component.

According to a second example using a manually-operated controller, real-time manual operation of the valve controller 90 is accomplished via electronically-received user input. In some implementations, the valve controller 90 includes electronic circuitry and components for receiving and transmitting wireless communications. For example, in certain implementations, the valve controller 90 includes a Bluetooth-compatible transceiver, a Wi-Fi compatible transceiver, or a transceiver configured to receive and transmit other standards of wireless communications. The transceiver of the valve controller 90 can communicate wirelessly with a user's or system's electronic communication device 91, such as a mobile phone, wearable device, laptop, desktop, tablet, satellite, short-wave or long-wave radio, and the like, to at least receive real-time manually-initiated commands from the user to open and close the valve 81. In this manner, the electronic communication device 91 of the user functions much like an electronic version of a physically actuatable component by providing a virtual knob, switch, handle, wheel, button, etc. that a user can select electronically to manually control the valve 81. The transceiver communicates the commands to a power-assist device of the valve controller 90, such as via electronic circuitry of the valve controller 90, to actuate the power-assist device for opening and closing the valve 81. Accordingly, in some implementations, a user can manually control the opening and closing of the valve 81 wirelessly from an electronic device 91 with real-time inputs whether the user is in close proximity or remote from the valve controller 90.

In some examples, the valve controller 90 is an automatically-operated controller. In a third example, automatic operation of the valve controller 90 is accomplished without real-time inputs from a user. According to certain implementations of the third example, the valve controller 90 includes a sensing device 95 to sense certain conditions. When the conditions sensed by the sensing device 95 meet some predetermined or user-defined threshold, the valve controller 90 is configured to automatically open and/or close the valve 81. In one implementation, the sensing device 95 is a physical condition sensor, such as a moisture sensor (e.g., a polymeric or otherwise expansion-contraction material configured to expand or contract in the presence of certain moisture saturation conditions), humidity sensor, water-level sensor, temperature sensor, light sensor, motion sensor, electrical current sensor, acoustic sensor, pressure sensor, facial recognition sensor, identification sensor (e.g. radio frequency identification (RFID), gas sensor, wind sensor, and the like, to detect physical conditions in real-time. According to another implementation, the sensing device 95 is a timer, a meter, or condition prediction device, that automatically controls the opening and/or closing of the valve 81 based on a predetermined time, schedule, or predictive conditions. In one implementation, the condition prediction device is configured to predict conditions, such as the weather. In certain examples, the apparatus 80 can include two or more of the power-assist device 93, the physically actuatable component 94, and the sensing device 95.

According to certain other implementations of the third example, the valve controller 90 communicates with a remote sensing device, which can be represented by the feature 91, that senses certain conditions, such as physical conditions or time-based conditions as described above. The remote sensing device can be a stand-alone sensing device or form part of or be coupled to an electronic communication device, which can also be represented by the feature 91, such as one described above. Like the local sensing device 95 of the valve controller 90 discussed above, when conditions sensed by the remote sensing device meet some predetermined or user-defined threshold, the remote sensing device communicates, such as via wireless communications, with the valve controller 90, which is configured to responsively automatically open and/or close the valve 81.

Figure 6:
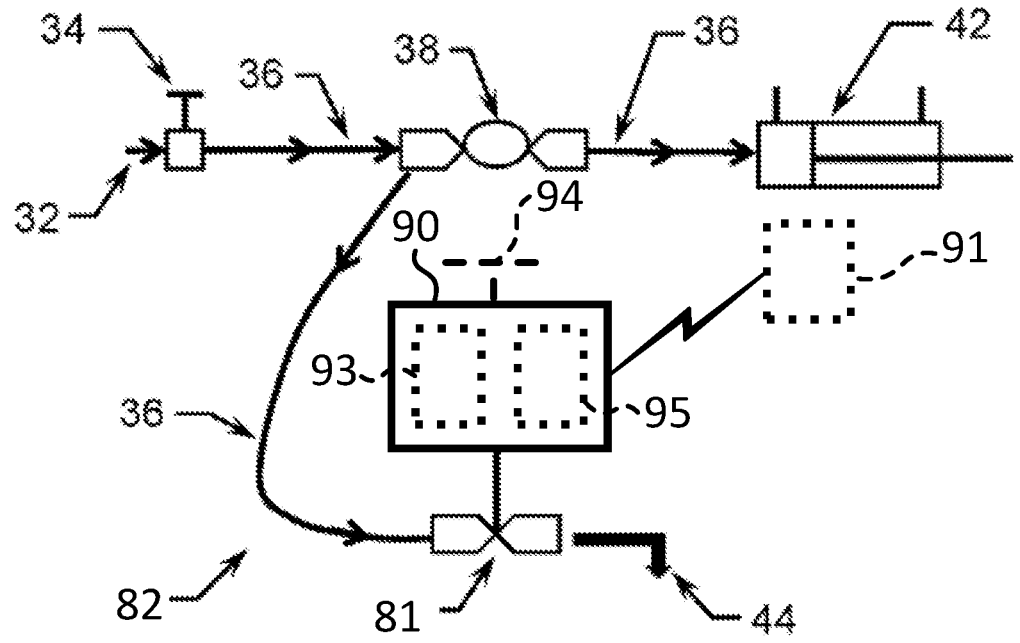
FIG. 6 is a schematic view of an actuation apparatus having a float valve water dump line, according to one or more examples of the present disclosure.

Referring to FIG. 6, according to yet another example, an actuation apparatus 82 includes features similar to the actuation apparatus 30 of FIG. 2, with like numbers referring to like features. The general functionality of the actuation apparatus 82, as it relates to control of an actuator, such as the actuator 42, is similar to that of the actuation apparatus 30 as described above. However, unlike the actuation apparatus 30 of FIG. 2, the actuation apparatus 82 of FIG. 6 includes the valve 81 and the valve controller 90 instead of a water level sensing float valve 40. The valve 81 and the valve controller 90 can be configured in the same manner as or a manner similar to the valve 81 and the valve controller 90 described above in association with FIG. 5.

The actuation apparatus 80 of FIG. 5 and the actuation apparatus 82 of FIG. 6 can be incorporated into an actuating toiler in a manner similar to the incorporation of the actuation apparatus 10 into the toilet 60 as shown and described in association with FIG. 4.

Additionally, as used herein, the term water can be used interchangeably with fluid. In other words, any reference to water can be replaced with fluid (or liquid) and any reference to fluid (or liquid) can be replaced with water. In this manner, the specific examples disclosed herein are not limited to any particular type of fluid or liquid.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." Moreover, unless otherwise noted, as defined herein a plurality of particular features does not necessarily mean every particular feature of an entire set or class of the particular features.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The schematic flow chart diagrams included herein are generally set forth as logical flow chart diagrams. As such, the depicted order and labeled steps are indicative of one example of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present subject matter may be embodied in other specific forms without departing from its spirit or essential characteristics. The described examples are to be considered in all respects only as illustrative and not restrictive. All changes which come within the meaning and range of equivalency of the claims are to be embraced within their scope.

What is claimed is:

1. An actuation apparatus, comprising:

a diaphragm valve, having an upstream side and a downstream side, opposite the upstream side;

a hydraulic actuator, fluidically coupled with the downstream side of the diaphragm valve by a first hydraulic line;

a valve fluidically coupled with the upstream side of the diaphragm valve by a second hydraulic line; and a valve controller coupled with the valve and operable to open and close the valve;

wherein:

pressurized fluid from the downstream side of the diaphragm valve flows to the hydraulic actuator, via the first hydraulic line, in response to opening of the valve; and the hydraulic actuator is configured to actuate in response to receipt of pressurized fluid from the downstream side of the diaphragm valve.

2. The actuation apparatus according to claim 1, wherein the valve and the valve controller are spatially remote from the diaphragm valve.

3. The actuation apparatus according to claim 1, wherein the valve and the valve controller are spatially remote from the diaphragm valve by a distance corresponding with a length of the second hydraulic line.

4. The actuation apparatus according to claim 1, further comprising a pressurized fluid supply, fluidically coupled with the upstream side of the diaphragm valve by a third hydraulic line to supply pressurized fluid to the upstream side of the diaphragm valve, wherein pressurized fluid from the upstream side of the diaphragm valve is supplied to the valve via the second hydraulic line.

5. The actuation apparatus according to claim 4, wherein pressurized fluid from the valve is supplied to the downstream side of the diaphragm valve, via a fourth hydraulic line, when the valve is open.

6. The actuation apparatus according to claim 4, further comprising a dump port fluidically coupled with the valve, wherein the valve is configured to supply a portion of pressurized fluid received from the diaphragm valve to the dump port when the valve is open.

7. The actuation apparatus according to claim 4, wherein the diaphragm valve supplies pressurized fluid to the hydraulic actuator only by non-mechanical hydraulic actuation of the diaphragm valve by pressurized fluid from the pressurized fluid supply.

8. The actuation apparatus according to claim 1, wherein the diaphragm valve supplies pressurized fluid to the hydraulic actuator only by non-mechanical hydraulic actuation of the diaphragm valve caused by pressurized fluid passing through the valve.

9. The actuation apparatus according to claim 1, wherein:

the valve controller comprises a sensing device configured to sense at least one condition; and the valve controller is configured to either open or close the valve in response to the at least one condition, sensed by the sensing device, meeting a predetermined threshold.

10. The actuation apparatus according to claim 1, wherein the valve controller is configured to either open or close the valve according to a predetermined schedule.

11. The actuation apparatus according to claim 1, wherein the valve is non-electrically coupled with the diaphragm valve.

12. The actuation apparatus according to claim 1, wherein:

the valve controller is configured to receive a wireless communication signal form an electronic device; and the valve controller is configured to either open or close the valve in response to receipt of the wireless communication signal.

13. The actuation apparatus according to claim 1, wherein:

the valve controller comprises a physically actuatable component; and the valve controller is configured to either open or close the valve in response to the physically actuatable component being physically actuated.

14. An actuation apparatus, comprising:

a diaphragm valve, having an upstream side and a downstream side, opposite the upstream side;

a hydraulic actuator, fluidically coupled with the downstream side of the diaphragm valve by a first hydraulic line; and a valve, fluidically coupled with the upstream side of the diaphragm valve by a second hydraulic line; and a valve controller coupled with the valve and operable to open and close the valve;

wherein:

pressurized fluid from the downstream side of the diaphragm valve flows to the hydraulic actuator, via the first hydraulic line, in response to opening of the valve;

the hydraulic actuator is configured to actuate in response to receipt of pressurized fluid from the downstream side of the diaphragm valve; and the diaphragm valve and the hydraulic actuator are exclusively fluidically-powered and non-electric.

15. The actuation apparatus according to claim 14, wherein the valve is spatially remote from the diaphragm valve.

16. The actuation apparatus according to claim 14, wherein:

the valve controller comprises a sensing device configured to sense at least one condition; and the valve controller is configured to either open or close the valve in response to the at least one condition, sensed by the sensing device, meeting a predetermined threshold.

17. The actuation apparatus according to claim 14, wherein the valve controller is configured to either open or close the valve according to a predetermined schedule.

18. The actuation apparatus according to claim 14, wherein:

the valve controller is configured to receive a wireless communication signal form an electronic device; and the valve controller is configured to either open or close the valve in response to receipt of the wireless communication signal.

19. The actuation apparatus according to claim 14, wherein:

the valve controller comprises a physically actuatable component; and the valve controller is configured to either open or close the valve in response to the physically actuatable component being physically actuated.

20. A toilet, comprising:

a diaphragm valve, having an upstream side and a downstream side, opposite the upstream side;

a hydraulic actuator, fluidically coupled with the downstream side of the diaphragm valve by a first hydraulic line;

a valve fluidically coupled with the upstream side of the diaphragm valve by a second hydraulic line; and a valve controller coupled with the valve and operable to open and close the valve;

wherein:

pressurized fluid from the downstream side of the diaphragm valve flows to the hydraulic actuator, via the first hydraulic line, in response to opening of the valve; and the hydraulic actuator is configured to actuate in response to receipt of pressurized fluid from the downstream side of the diaphragm valve.

* * * * *